US010131044B2

(12) United States Patent
Scott

(10) Patent No.: US 10,131,044 B2
(45) Date of Patent: Nov. 20, 2018

(54) FORK SEAL DRIVER TOOL

(75) Inventor: Steven Richard Scott, Belmont, CA (US)

(73) Assignee: Motion Pro, INC., Loomis, CA (US)

( * ) Notice: Subject to any disclaimer, the term of this patent is extended or adjusted under 35 U.S.C. 154(b) by 941 days.

(21) Appl. No.: 13/168,975

(22) Filed: Jun. 26, 2011

(65) Prior Publication Data

US 2012/0102698 A1 May 3, 2012

Related U.S. Application Data

(60) Provisional application No. 61/369,623, filed on Jul. 30, 2010.

(51) Int. Cl.
*B25B 27/00* (2006.01)

(52) U.S. Cl.
CPC ..... *B25B 27/0028* (2013.01); *Y10T 29/53657* (2015.01)

(58) Field of Classification Search
CPC ..... B25B 23/0007; B25B 23/0028
USPC ..... 29/255, 270, 278, 257, 280, 272, 282; 285/314–316, 320, 377, 419, 373; 81/120
See application file for complete search history.

(56) References Cited

U.S. PATENT DOCUMENTS

| | | | | |
|---|---|---|---|---|
| 4,008,937 | A * | 2/1977 | Filippi | F16L 23/06 174/78 |
| 4,247,163 | A * | 1/1981 | Lumpp et al. | 385/136 |
| 4,570,481 | A | 2/1986 | McLaurin | |
| 6,257,792 | B1 * | 7/2001 | Read, Jr. | 403/16 |
| 6,276,036 | B1 | 8/2001 | Cairns | |
| 6,360,408 | B1 * | 3/2002 | Dykstra et al. | 24/598.7 |
| 7,107,803 | B1 | 9/2006 | Swanson | |
| 2002/0109349 | A1 | 8/2002 | Rochelle | |
| 2004/0126182 | A1 * | 7/2004 | Lin | 403/322.2 |
| 2007/0240281 | A1 | 10/2007 | Meissner | |

OTHER PUBLICATIONS

Buzzeti, Catalog [online], Dec. 2009 (Dec. 2009), Retrieved from the Internet: http://web.archive.org/web/200912291229190 3 35/http :/ /www , skutrbazar, cz/katalogylbuzzeti.pdf>p. 62.*

Buzzeti, Catalog [online], Dec. 2009 (Dec. 2009), Retrieved from the Internet<URL: http://web.archive.org/web/200912291229190335/ http://www,skutrbazar.cz/katalogy/buzzeti.pdf>p. 62.

* cited by examiner

*Primary Examiner* — David Bryant
*Assistant Examiner* — Nirvana Deonauth
(74) *Attorney, Agent, or Firm* — Larry B. Guernsey; Patent Law Office of Larry Guernsey

(57) ABSTRACT

A fork seal driver tool includes two half-cylindrical pieces and a rotating retaining ring which rotates to hold the half-cylindrical pieces together.

13 Claims, 7 Drawing Sheets

FORK SEAL DRIVER TOOL

The following non-provisional patent application claims priority to U.S. Provisional Patent Application Ser. No. 61/369,623, filed Jul. 30, 2010 to the present inventor.

TECHNICAL FIELD

The present invention relates generally to devices for repairing mechanical parts and more particularly to tools for servicing the oil seal of the fork of a motorcycle.

BACKGROUND ART

The front wheel of a motorcycle is usually linked to the frame by a pair of fork tubes. These tubes house the front suspension and usually include springs and compartments filled with fork oil to act as a shock absorber, which protects the rider from bumps and vibrations as the vehicle travels uneven surfaces.

The most common form of fork commercially available is a telescopic fork which uses fork tubes which contain the suspension components (coil springs and damper) internally. This design is simple and inexpensive to manufacture, and relatively light compared to designs based on external components and linkage systems.

The systems that rely on using fork oil as a damper, use oil seals to contain the oil in a space within the fork tubes. This oil needs to be replenished or replaced periodically and to do this, the structure needs to be at least partially disassembled, which usually involves removing or replacing the oil seals. These seals generally take the form of annular rings which fit around the central tube and which seat in position to contain the oil without leakage. In order to ensure that these seals are properly seated, generally a fork seal driver is used. This fork seal driver is generally a cylindrical structure which encircles the central tube and slides along its length until it contacts the fork seal and drives it to seat properly. Thus, it acts as a form of small slide hammer.

FIG. 1 shows the principle elements of a fork tube assembly 1 with a fork seal driver 2 in place. The fork inner leg 3 has a first end 5 including the slider bushing 17 which slides within the fork outer leg 4. At the second end 6 of the fork inner leg 3, there is a fork lug 7. The fork outer leg 4 has a fork cap 8 at its first end 9, and its second end 10 includes a fork seal seat 12, which includes a backup ring, an oil seal stopper groove 11, and a guide bushing 13. The fork seal 14 slides into the second end 10 of the fork outer leg 4 against the fork seal seat 12. The oil seal stopper 15 then is pressed against the fork seal 14 into the oil seal stopper groove 11 to help maintain the fork seal's 14 position.

The fork seal 14 seats generally in a plane 18 perpendicular to the longitudinal axis 19 of the fork tube assembly 1. The driver 2 ideally contacts all points of the fork seal 14 in this plane 18 and moves them in the direction of the longitudinal axis 19 together, so that the fork seal 14 is pressed properly into the fork seal seat 12 and the oil seal stopper 15 seats properly against the oil seal stopper groove 11, and both are not damaged. In order for the driver 2 to best travel in this length axis 19 direction without skewing or binding, the diameter of the inner bore 16 of the driver 2 closely matches the diameter of the fork inner leg 3 along which it travels. The fork inner leg 3 may preferably have attached fork lug 7 still in place, which has a larger diameter. It is generally undesirable to remove the fork lug 7 for this operation, and the inner bore 16 diameter of the driver 2 does not allow the driver 2 to be slipped onto the end of the fork tube assembly 1 past the fork lug 7 without further disassembly.

Instead, as shown in FIG. 2, fork seal drivers 2 are generally configured as two half-cylindrical pieces 30 which mate together around the fork inner leg 3, to form a cylindrical body 32. The half-cylindrical pieces 30 are fitted together by means of pins 34 on a first half-cylindrical piece 36, which is a male part 38, which fit into matching holes 40 in the second half-cylindrical piece 42, thus a female part 44. These half-cylindrical parts 30 are generally machined as a complete cylindrical piece, and then cut in half. The first piece 36 has pins 34 installed, and the second piece 42 has holes 40 bored to match the placement and length of the pins 34.

Ideally, the two half-cylindrical pieces 36, 42 reunite to re-form the original cylindrical body configuration 32, in which a bottom driver edge 46, forms a uniform contact plane 48 for driving and seating the fork seal 14. The driver 2 also preferably includes an outer bore step 50 and an internal bore step 52, which help to carry the fork seal 14 and drive it into the fork seal seat 12 squarely.

However, it can be appreciated that splitting the original cylindrical piece 32 into two half-cylindrical pieces 36, 42 must be a fairly precise operation, and that installing the mating pins 34 and mating holes 40 also requires fairly tight tolerances. The necessity for such tight tolerances can produce parts that are rather costly and require precise manufacturing processes. Further, each separate part must be produced with these same tight tolerances, thus the manufacturing and machining must be repeatably precise, or else there can be an expensively high failure rate for the parts.

In addition, the pins and holes in the male and female parts are included merely to locate the pieces properly, and are not used to hold them in place during the driving operation. Instead the parts are generally held by the user's hand, as the driver slides up and down, and can easily come apart completely if not held correctly. Worse yet, the parts may come apart slightly, but not completely, so that a uniform contact surface is not formed by the lower edge of the driver. An uneven contact surface may cause damage to the seals and or the outer fork leg, whereby they may need to be replaced entirely, at greater expense and expenditure of time.

Yet further, as the driver is fashioned into two separate male and female parts, production costs are increased compared to a situation where there is only one uniform kind of part, and two of these uniform parts are held together in a different, more secure manner.

Thus, there is a need for a fork seal driver which is easier and less costly to manufacture, which may not use separate male and female mating parts, and which is held together securely to minimize damage to seals as they are driven.

DISCLOSURE OF INVENTION

Briefly, one preferred embodiment of the present invention is a fork seal driver tool, including two half-cylindrical pieces and a rotating retaining ring which rotates to hold the half-cylindrical pieces together.

An advantage of the present invention is that it presents a fork seal driver tool in which the necessity for tight tolerances in precisely mating parts is reduced.

Another advantage of the present invention is that manufacturing costs are reduced since the tolerances of parts can be less tight than in previous drivers.

And another advantage of the present invention is that it uses unisex parts rather than male and female parts, which produces reduced manufacture costs.

A further advantage of the present invention is that the halves of the driver tool are held securely together, presenting a uniform contact surface to contact the fork seal.

A yet further advantage of the present invention is that there is reduced risk of damage to the fork seal that is being driven.

Another advantage of the present invention is that it eliminates the use of pins and locating holes in the half-cylindrical pieces.

Another advantage of the present invention is that one half of the tool cannot fall off in use and hit another part of the vehicle and damage it, or hit the user and cause injury to the user.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

DESCRIPTION OF THE PREFERRED EMBODIMENTS

The present invention is a fork seal driver tool, which will be referred to by the reference number 100, and thus shall be referred to as driver tool 100. A preferred embodiment of the driver tool 100 is illustrated in FIGS. 3-7. For purposes of the following discussion, regarding concentric elements or surfaces, the term "inner" shall refer to an element closer to the longitudinal axis of the fork legs, and "outer" shall refer to those elements that are farther away from this axis.

Generally speaking, there are some features of the driver tool that are similar to those of previous drivers, as described previously. When appropriate, similar element numbers will be used in the following discussion.

Figure 1:
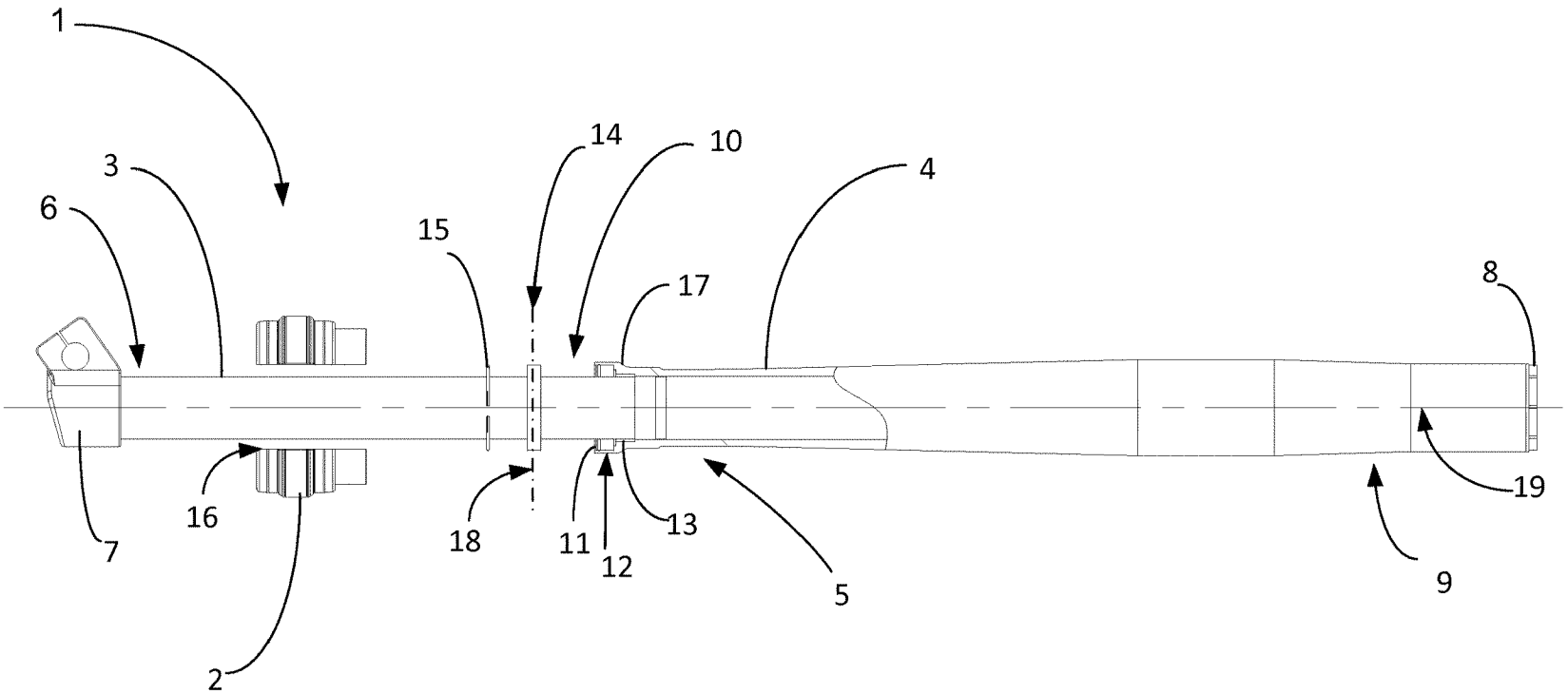
FIG. 1 shows a side elevation view and partial cut-away of a fork assembly with inner and outer legs with a fork seal and fork seal driver.
Figure 2:
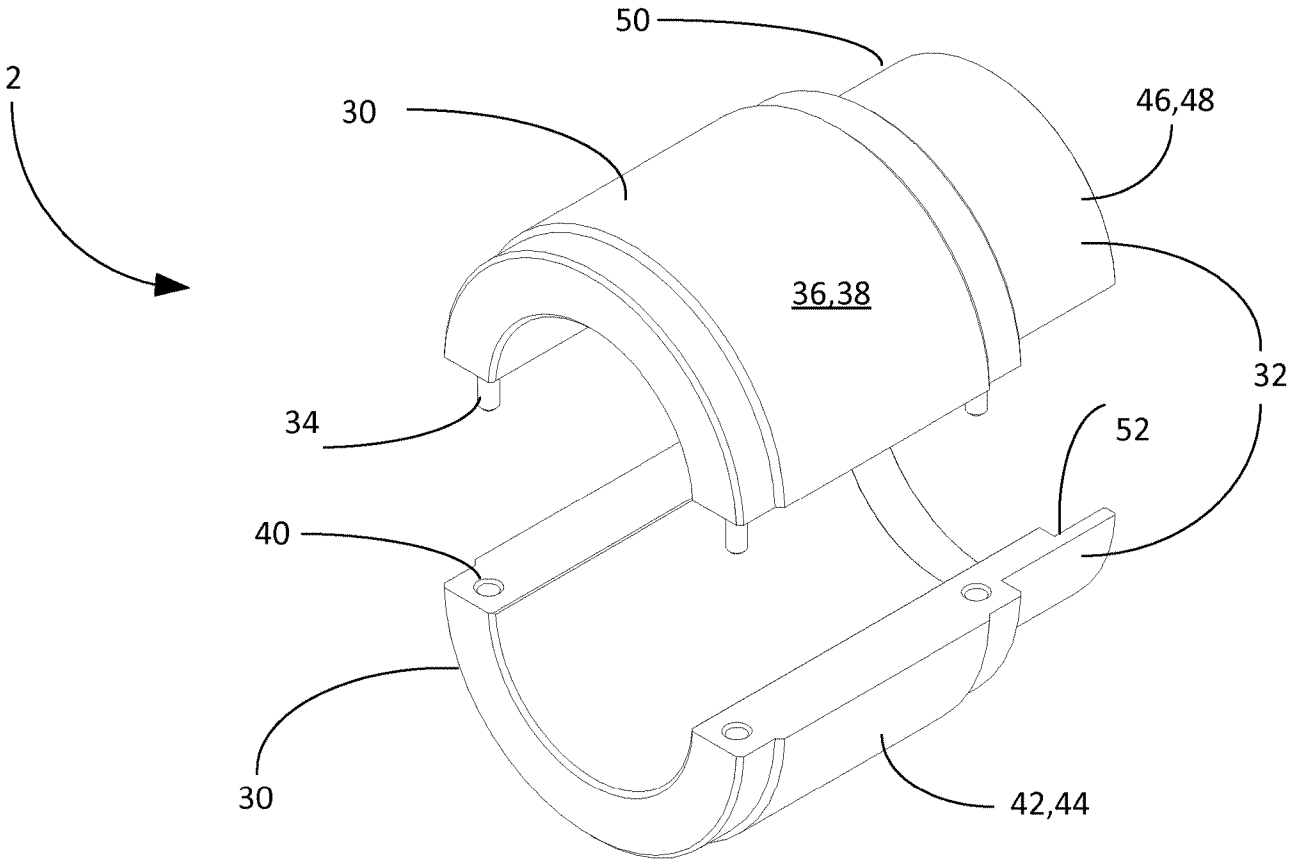
FIGURE 2 Prior art
FIG. 2 shows an isometric view of a fork seal driver of the prior art.
Figure 3:
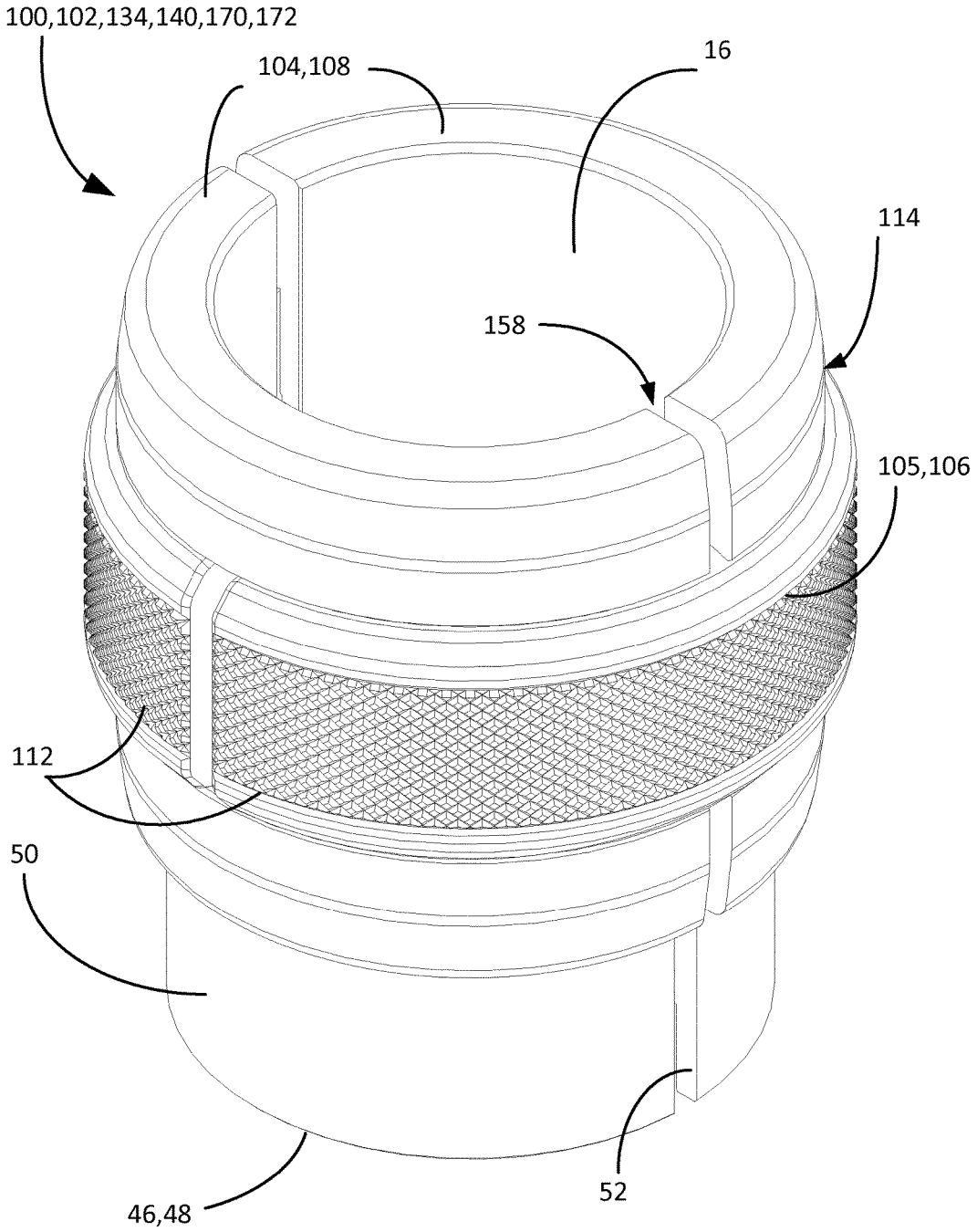
FIG. 3 shows an isometric view of fork seal driver tool of the present invention.

The present driver 100 is shown particularly in FIG. 3, which is an isometric view of the assembled driver 102 with its two half-cylindrical pieces 104 bound together by a locking device 105, which is preferably a rotating retaining ring 106. A major difference between the present invention 100 and previous drivers is that instead of a male part and a female part that the previous driver used, the two half-cylindrical pieces 104 of the present invention 100 do not use pins and holes to position the pieces. Instead, two identical symmetrical parts 108 are used, which greatly simplifies the manufacturing process and reduces the cost. The driver 100 also preferably includes an outer bore step 50 and an internal bore step 52.

As before, these half-cylindrical symmetrical parts 108 are generally machined as a complete cylindrical piece, and then cut in half. However, there is then no necessity to bore holes and install pins, as done previously, which simplifies the manufacturing process.

The driver 100 includes an inner bore 16 which again is preferably closely matched to the outer diameter of the fork inner leg 3 so that it slides smoothly without rattling or skewing. For this reason, drivers 100 are fabricated with specific sizes that match with specific sizes of fork, so that, for example, a user may buy a 45 mm driver, etc.

The rotating retaining ring 106 actually includes two retaining ring elements 112 which rotate in a groove 114. As better seen in FIGS. 4 and 5, this groove 114 is an undercut groove 116 in which the inner width 118 of the groove 114 is greater than the outer width 120 of the groove 114. Correspondingly, the inner width 122 of the retaining ring elements 112 is greater than the outer width 124 of the retaining ring elements 112, so that the retaining ring elements 112 are captured in the undercut groove 116, but are still free to rotate within the undercut groove 116.

For purposes of this discussion, a half-cylindrical piece 108 with its respective retaining ring element 112 installed in its groove 114, will be referred to as a driver half 110.

Figure 5:
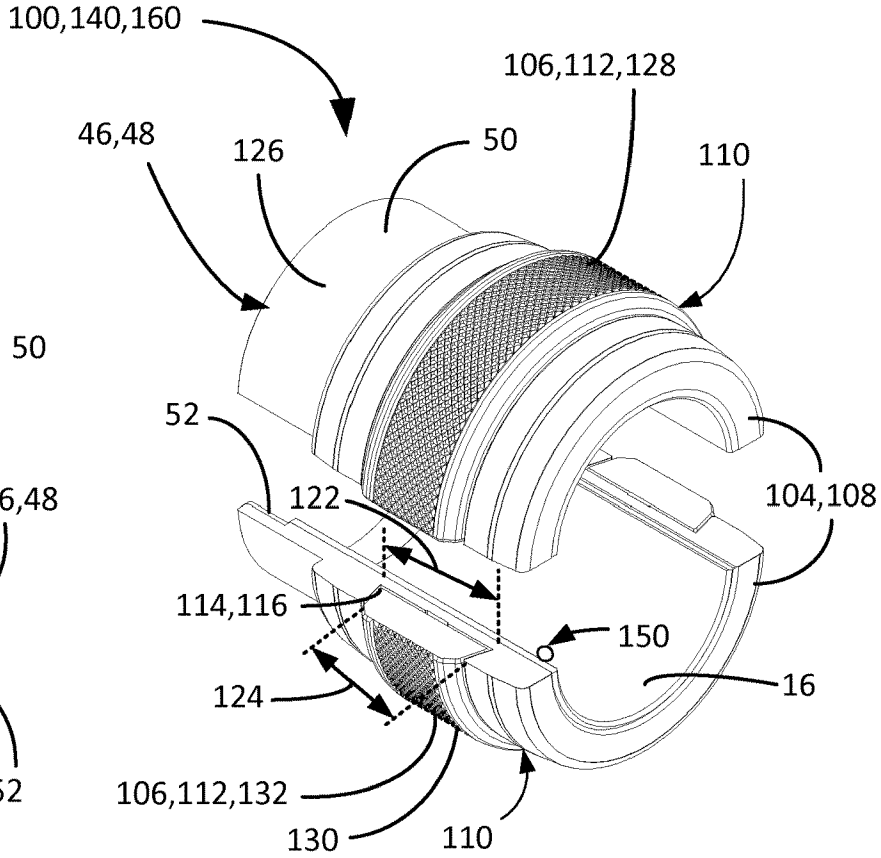
FIGS. 4-5 show isometric views of the fork seal driver tool of the present invention.
Figure 4:
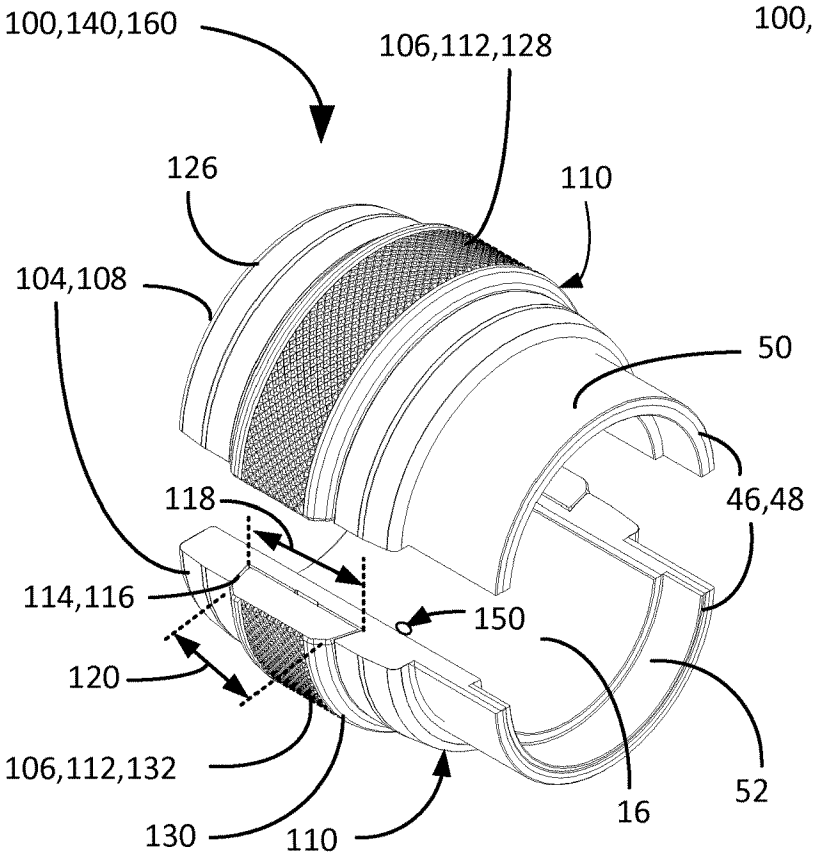
Figure 6:
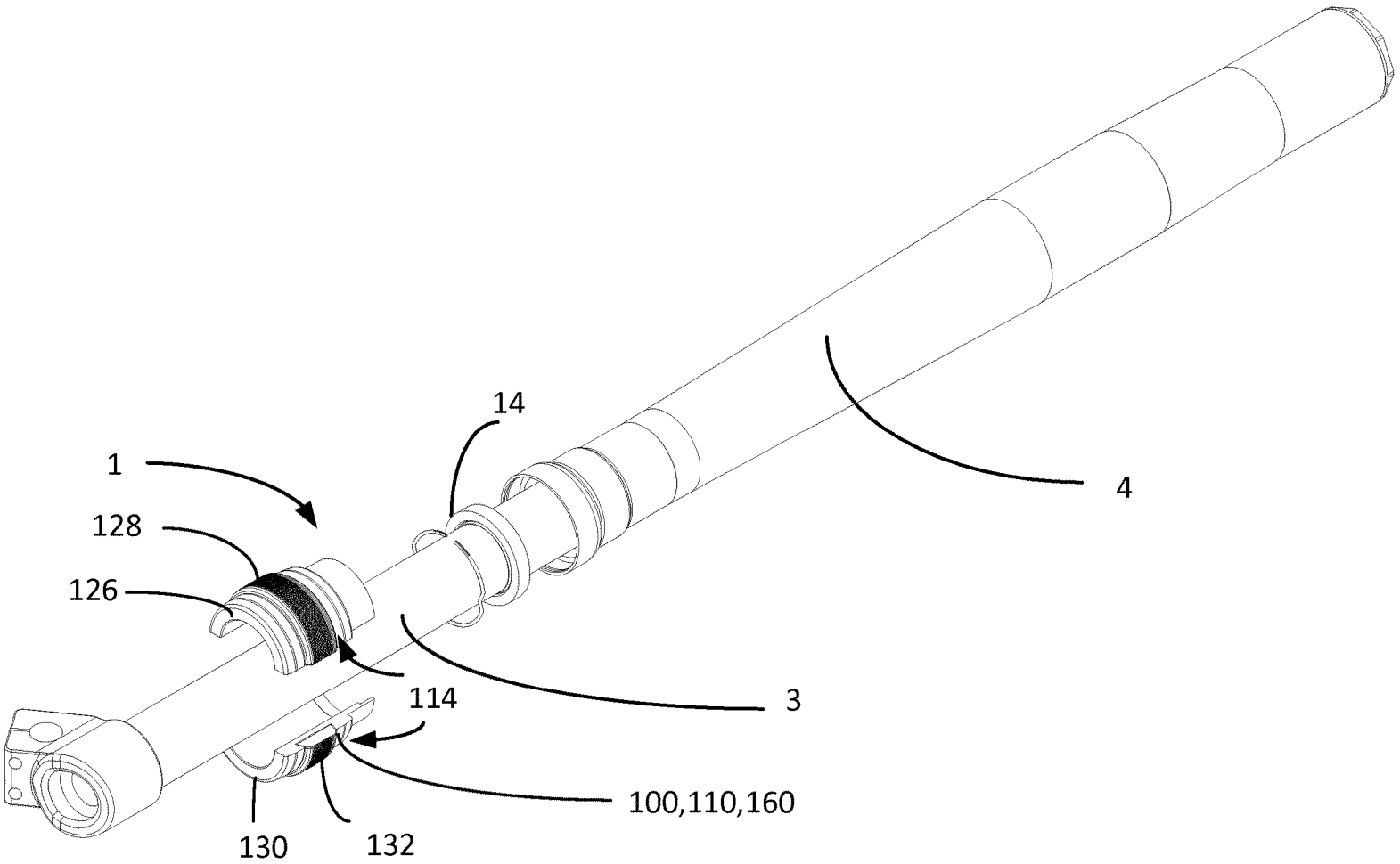
FIG. 6 shows an isometric top view of the fork seal driver tool of the present invention in open position being positioned on a fork inner leg.

In use, a first half-cylindrical piece 126 having a first retaining ring element 128 and a second half-cylindrical piece 130 having a second retaining ring element 132 are produced, with the respective retaining ring elements 128, 132 rotationally aligned with their half-cylindrical pieces 126, 130, as seen in FIGS. 4-5. These two driver halves 110 are placed in position around the fork inner leg 3, as seen in FIG. 6. This will be referred to as "open position 160".

Figure 7:
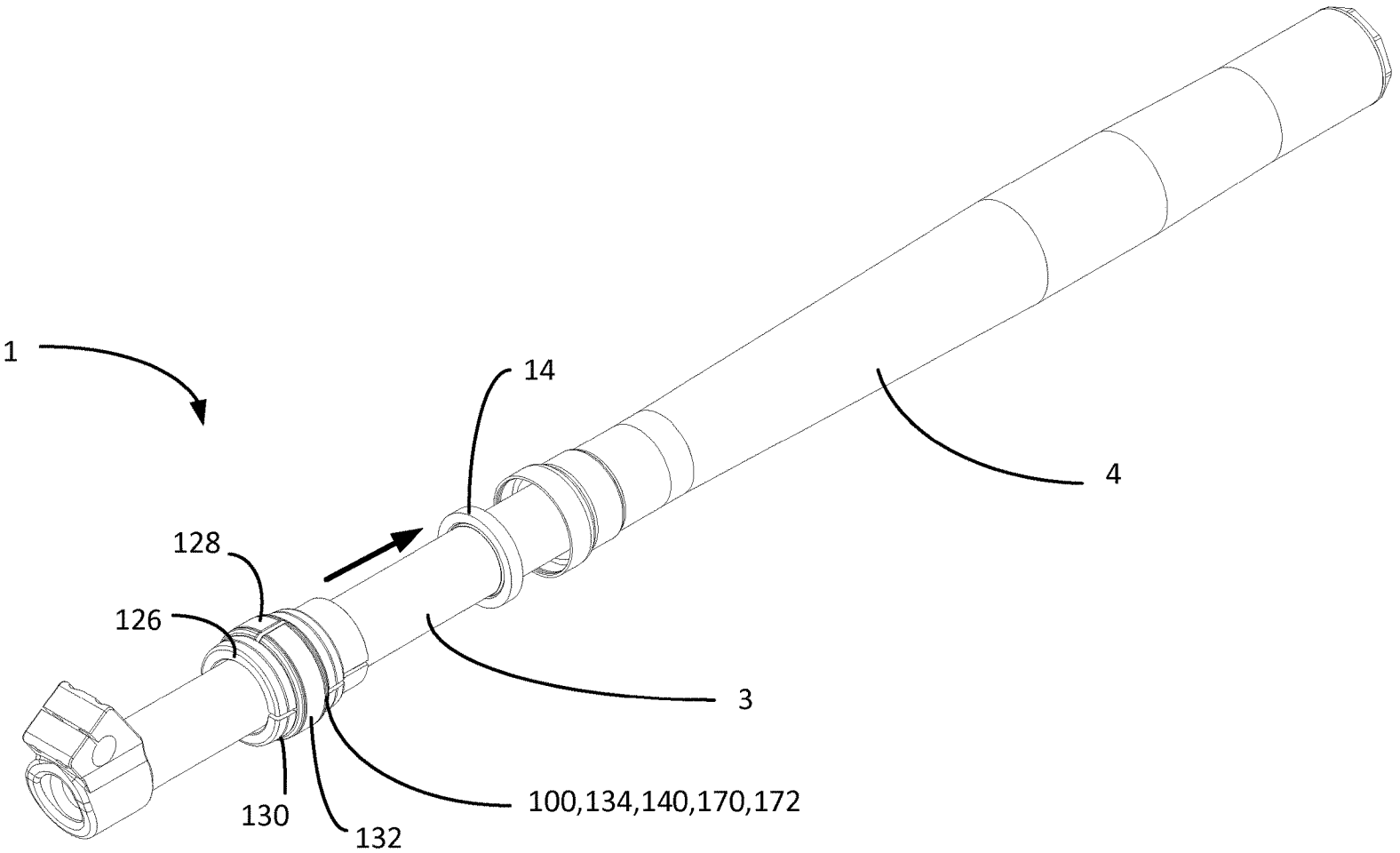
FIG. 7 shows an isometric top view of the fork seal driver tool of the present invention in closed position on a fork inner leg.

The two driver halves 110, which include the first half-cylindrical piece 126 having the first retaining ring element 128 and the second half-cylindrical piece 130 having the second retaining ring element 132, are brought together with their grooves 114 aligned. The retaining elements 112 are then rotated so that the first retaining ring element 128 enters the groove 114 of the second half-cylindrical piece 130, and the second retaining ring element 132 enters the groove 114 of the first half-cylindrical piece 126. The rotation is preferably continued to make a 90 degree rotation, so that half of the retaining ring elements 128, 132 are included in each of the grooves 114 of the first and second half-cylindrical pieces 126, 130, as seen in FIG. 7 and also in FIG. 3. This will be referred to as "closed position 170" or "locked position 172".

The two halves 110 of the driver 100 are now locked together to recreate the original cylindrical configuration 134. The driver 100 is held together securely, without pressure from the user to keep the pieces aligned.

If the half-cylindrical parts as in the prior art are held only by the user's hand, as the driver slides up and down, they can easily come apart completely if not held correctly. Worse yet, the parts may come apart slightly, but not completely, so that a uniform contact surface is not formed by the lower edge of the driver. An uneven contact surface may cause damage to the seals and or fork leg outer, whereby they may need to be replaced entirely, at greater expense and expenditure of time. In addition, if the driver parts come apart in use, one or both halves may turn into projectiles that can cause damage to other parts of the vehicle and to the user.

These difficulties may be avoided by using the present driver 100 which can be considered to be a fork seal driver with locking driver halves 110, which can be referred to briefly as a locking driver 140. The two half-cylindrical pieces 108 more easily reunite to re-form the original cylindrical configuration 134, in which a bottom driver edge 46 forms a uniform contact plane 48 for driving and seating the fork seal 14. Proper alignment of the parts is more easily assured, and costs for the parts is reduced, since lesser tolerances may be used when not fitting pins into mating holes, as previously practiced.

Figure 9:
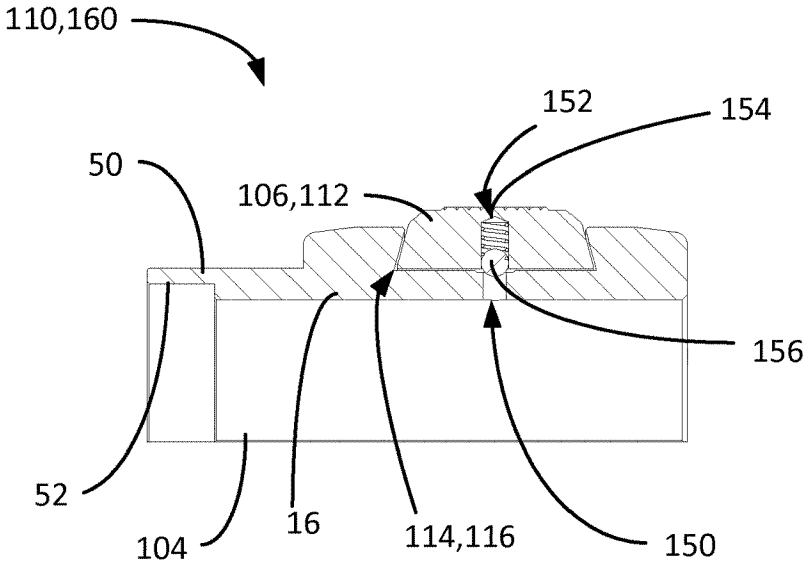
FIG. 9 is a cross-sectional view of the driver half of FIG. 8 as taken through line 9-9. detailed
Figure 8:
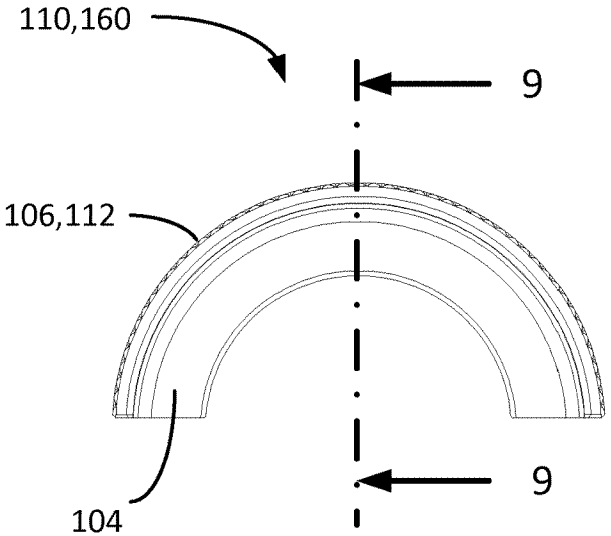
FIG. 8 shows the end elevation view of a driver half.

An optional feature which has been found to be useful and is presently preferred is a detent 150, which is shown in FIGS. 4-5, and 8-9. FIG. 8 shows an end view of a driver half 110, and FIG. 9 is a cross-sectional view as taken along line 9-9 in FIG. 8. FIG. 9 in particular shows the half-cylindrical piece 104 having bore 16, outer bore step 50, and inner bore step 52, as well as undercut groove 114, 116. Rotating retaining ring element 106, 112 is shown lodged in groove 114. The half-cylindrical piece 104 has a detent 150, which is a hole bored through the wall of the piece. This detent aligns with a matching cavity 152 in the retaining ring element 112, and a spring 154 and ball 156 are positioned within the cavity 152. The spring 154 urges the ball 156 to seat in the detent 150, and thus helps to maintain the retaining element 112 in position when the retaining element 112 is aligned with the half-cylindrical piece 104, i.e. When the driver 100 is in open position 160.

As seen in FIG. 3 particularly, the two half-cylindrical pieces 104 are joined to form a complete cylinder, and retaining ring elements 112 have been rotated 90 degrees to lock the two half-cylindrical pieces 104 together, i.e. When the driver 100 is in closed or locked position 170, 172. At this point, the two half-cylindrical pieces 104 are separated by a thin groove 160, which may correspond to the width of the saw blade which was used to cut the original cylindrical piece into the two separate half-cylindrical pieces 104. When in closed, locked position 170, 172, the ball 156 of the retaining element 112 seats in this groove 158, and helps to maintain the locked position 172 of the retaining ring 106.

While various embodiments have been described above, it should be understood that they have been presented by way of example only, and not limitation.

INDUSTRIAL APPLICABILITY

The present fork seal driver tool 100 is well suited generally for use in replacing or repairing fork seals in fork tube assemblies of motorcycles.

The principle elements of a fork tube assembly 1 include a fork inner leg 3 which has a first end 5 including the slider bushing 17 which slides within the fork outer leg 4. At the second end 6 of the fork inner leg 3, there is a fork lug 7. The fork outer leg 4 has a fork cap 8 at its first end 9, and its second end 10 includes a fork seal seat 12, which includes a backup ring, an oil seal stopper groove 11, and a guide bushing 13. The fork seal 14 slides into the second end 10 of the fork outer leg 4 against the fork seal seat 12. The oil seal stopper 15 then is pressed against the fork seal 14 into the oil seal stopper groove 11 to help maintain the fork seal's 14 position.

The fork seal 14 seats generally in a plane 18 perpendicular to the longitudinal axis 19 of the fork tube assembly 1. A fork seal driver ideally contacts all points of the fork seal 14 in this plane 18 and moves them in the direction of the longitudinal axis 19 together, so that the fork seal 14 is pressed properly into the fork seal seat 12 and the oil seal stopper 15 seats properly against the oil seal stopper groove 11, and both are not damaged.

The fork seal driver tool 100 of the present invention is embodied in the assembled driver 102 with its two half-cylindrical pieces 104 bound together by a rotating retaining ring 106. A major difference between the present invention 100 and previous drivers is that instead of a male part and a female part that the previous driver used, the two half-cylindrical pieces 104 of the present invention 100 do not use pins and holes to position the pieces. Instead, two identical symmetrical parts 108 are used, which greatly simplifies the manufacturing process and reduces the cost. The driver 100 includes an outer bore step 50 and an internal bore step 52.

These half-cylindrical symmetrical parts 108 are generally machined as a complete cylindrical piece, and then cut in half. However, there is then no necessity to bore holes and install pins, as done previously, which simplifies the manufacturing process.

The driver 100 includes an inner bore 16 which is closely matched to the outer diameter of the fork inner leg 3 so that it slides smoothly without rattling or skewing.

The rotating retaining ring 106 preferably includes two retaining ring elements 112 which rotate in a groove 114. This groove 114 is an undercut groove 116 in which the inner width 118 of the groove 114 is greater than the outer width 120 of the groove 114. Correspondingly, the inner width 122 of the retaining ring elements 112 is greater than the outer width 124 of the retaining ring elements 112, so that the retaining ring elements 112 are captured in the undercut groove 116, but are still free to rotate within the undercut groove 116. A half-cylindrical piece 108 with its respective retaining ring element 112 installed in its groove 114, will be referred to as a driver half 110.

In use, a first half-cylindrical piece 126 having a first retaining ring element 128 and a second half-cylindrical piece 130 having a second retaining ring element 132 are produced, with the respective retaining ring elements 128, 132 rotationally aligned with their half-cylindrical pieces 126, 130. These two driver halves 110 are placed in position around the fork inner leg, in what is referred to as "open position 160".

The two driver halves 110, which include the first half-cylindrical piece 126 having the first retaining ring element 128 and the second half-cylindrical piece 130 having the second retaining ring element 132, are brought together with their grooves 114 aligned. The retaining elements 112 are then rotated so that the first retaining ring element 128 enters the groove 114 of the second half-cylindrical piece 130, and the second retaining ring element 132 enters the groove 114 of the first half-cylindrical piece 126. The rotation is preferably continued to make a 90 degree rotation, so that half of the retaining ring elements 128, 132 are included in each of the grooves 114 of the first and second half-cylindrical pieces 126, 130. This will be referred to as "closed position 170" or "locked position 172".

The two halves 110 of the driver 100 are now locked together to recreate the original cylindrical configuration 134. The driver 100 is held together securely, without requiring pressure from the user to keep the pieces aligned.

If the half-cylindrical parts are held only by the user's hand, as in the prior art, as the driver slides up and down, they can easily come apart completely if not held correctly. Worse yet, the parts may come apart slightly, but not completely, so that a uniform contact surface is not formed by the lower edge of the driver. An uneven contact surface may cause damage to the seals and or fork leg outer, whereby they may need to be replaced entirely, at greater expense and expenditure of time. In addition, if the driver parts come apart in use, one or both halves may turn into projectiles that can cause damage to other parts of the vehicle and to the user.

These difficulties may be avoided by using the present fork seal driver tool 100 which can be considered to be a fork seal driver with locking driver halves 110, referred to briefly as a locking driver 140. The two half-cylindrical pieces 108 more easily reunite to re-form the original cylindrical configuration 134, in which a bottom driver edge 46, 48 forms a uniform contact plane 48 for driving and seating the fork seal 14. Proper alignment of the parts is more easily assured, and costs for the parts is reduced, since lesser tolerances may be used when not fitting pins into mating holes, as previously practiced.

An optional feature which has been found to be useful and is presently preferred is a detent 150. The half-cylindrical piece 104 having bore 16, outer bore step 50, and inner bore step 52, as well as undercut groove 114, 116. Rotating retaining ring element 106, 112 is lodged in groove 114. The half-cylindrical piece 104 has a detent 150, which is a hole bored through the wall of the piece. This detent aligns with a matching cavity 152 in the retaining ring element 112, and a spring 154 and ball 156 are positioned within the cavity 152. The spring 154 urges the ball 156 to seat in the detent 150, and thus helps to maintain the retaining element 112 in position when the retaining element 112 is aligned with the half-cylindrical piece 104, i.e. When the driver 100 is in open position 160.

The two half-cylindrical pieces 104 are joined to form a complete cylinder, and retaining ring elements 112 have been rotated 90 degrees to lock the two half-cylindrical pieces 104 together, i.e. when the driver 100 is in closed position. At this point, the two half-cylindrical pieces 104 are separated by a thin groove 160, which may correspond to the width of the saw blade which was used to cut the original cylindrical piece into the two separate half-cylindrical pieces 104. When in closed, locked position 170, 172, the ball 156 of the retaining element 112 seats in this groove 158, and helps to maintain the locked position of the retaining ring 106.

The fork seal driver tool 100 thus presents a tool that is easier and less expensive to manufacture than previous tools for this purpose, and which locks together in a manner which minimizes slippage and possible damage to expensive elements of the motorcycle fork.

For the above, and other, reasons, it is expected that the fork seal driver tool 100 of the present invention will have widespread industrial applicability. Therefore, it is expected that the commercial utility of the present invention will be extensive and long lasting.

The invention claimed is:

1. A fork seal driver tool comprising: two separable half-cylindrical pieces: and a rotating ring which rotates to hold said half-cylindrical pieces together when in a locked position, wherein said rotating retaining ring comprises two separable retaining ring elements, and wherein said half-cylindrical pieces include an undercut groove having an inner groove width which is wider than its outer groove width in which said retaining ring elements are channeled, said separable retaining ring elements being captured in said undercut grooves such that each said separable half-cylindrical piece and separable retaining ring element together comprise one driver half which is completely separable from another driver half when in an unlocked position, and which join together when in a locked position; wherein each said half-cylindrical pieces include an outer bore step on an exterior surface and an inner bore step on an interior surface of each said half-cylindrical piece.

2. The fork seal driver tool of claim 1, wherein said two half-cylindrical pieces are identical half-cylindrical pieces.

3. The fork seal driver tool of claim 2, wherein said identical half-cylindrical pieces are unisex parts.

4. The fork seal driver tool of claim 1, further comprising at least one detent.

5. The fork seal driver tool of claim 4, wherein each said at least one detent includes a ball, a cavity, and a spring.

6. The fork seal driver tool of claim 5, wherein said at least one detent aligns with a groove formed between said two half-cylindrical pieces when retaining ring elements are rotated to hold said half-cylindrical pieces together in a locked position, said detent serving to help maintain said locked position.

7. The fork seal driver tool of claim 1, wherein said fork seal driver tool has a bottom contact edge which is a uniform contact plane.

8. The fork seal driver tool of claim 1, wherein said two half-cylindrical parts lock together so that said fork seal driver tool is a locking driver.

9. A fork seal driver tool, comprising: two identical separable driver halves including a locking device, wherein each of said two identical driver halves including said locking device comprises a half-cylindrical piece and a retaining ring element; and wherein each of said half-cylindrical pieces includes an undercut groove having an inner groove width which is wider than its outer groove width in which said retaining ring elements are channeled, said retaining ring elements being captured in said undercut grooves such that each said separable driver half is completely separable from another driver half when in an unlocked position, and which join together when in a locked position; wherein each said half-cylindrical pieces include an outer bore step on an exterior surface and an inner bore step on an interior surface of each said half-cylindrical piece.

10. The fork seal driver tool of claim 9, further comprising at least one detent.

11. The fork seal driver tool of claim 10, wherein each said at least one detent includes a ball, a cavity, and a spring.

12. The fork seal driver tool of claim 11, wherein said at least one detent aligns with a groove formed between said two half-cylindrical parts when said retaining ring elements are rotated to hold said half-cylindrical parts together in a locked position, said detent serving to maintain said locked position.

13. A fork seal driver tool having a locked and an unlocked position comprising: a first driver half and a second driver half, wherein each driver half comprises a half-cylindrical piece and a retaining ring element, and wherein each of said half-cylindrical pieces include an undercut groove having an inner groove width which is wider than its outer groove width in which each of said retaining ring elements are channeled, said driver halves being completely separable when said retaining ring elements are in unlocked position, and when in locked position, said two driver halves are aligned such that said retaining ring element of said first driver half is rotated into said undercut channel of said second driver half, and said retaining element of said second driver half is rotated into said undercut channel of said first driver half; wherein each said half-cylindrical pieces include an outer bore step on an exterior surface and an inner bore step on an interior surface of each said half-cylindrical piece.

* * * * *